US007717298B2

(12) United States Patent
Jobmann

(10) Patent No.: US 7,717,298 B2
(45) Date of Patent: May 18, 2010

(54) BLOCKING DEVICE FOR A BEVERAGE DISPENSER

(75) Inventor: Wolfgang Jobmann, Hamburg (DE)

(73) Assignee: Wolfgang Jobmann GmbH, Hamburg (DE)

( * ) Notice: Subject to any disclaimer, the term of this patent is extended or adjusted under 35 U.S.C. 154(b) by 897 days.

(21) Appl. No.: 10/538,251

(22) PCT Filed: Dec. 12, 2003

(86) PCT No.: PCT/EP03/14168

§ 371 (c)(1),
(2), (4) Date: Jun. 9, 2005

(87) PCT Pub. No.: WO2004/054920

PCT Pub. Date: Jul. 1, 2004

(65) Prior Publication Data

US 2006/0027600 A1 Feb. 9, 2006

(30) Foreign Application Priority Data

Dec. 16, 2002 (EP) ..... 02028267

(51) Int. Cl.
*B67B 5/00* (2006.01)

(52) U.S. Cl. ..... 222/153.03; 222/153.14; 292/251.5

(58) Field of Classification Search ..... 222/153.01, 222/153.03, 153.04, 153.09, 153.1, 153.14; 292/251.5, DIG. 18; 70/DIG. 8; 220/324; 312/107.5, 215–221, 333

See application file for complete search history.

(56) References Cited

U.S. PATENT DOCUMENTS 2,083,621 A 6/1937 Smith
2,809,062 A 10/1957 Manhardt
4,519,219 A * 5/1985 Prepodnik et al. ..... 62/457.1
4,660,742 A * 4/1987 Ozdemir ..... 222/36
5,507,411 A * 4/1996 Peckels ..... 222/1

FOREIGN PATENT DOCUMENTS

DE 295 12 609 U1 8/1995
EP 1 132 316 A1 3/2000
NL 8402362 7/1984

* cited by examiner

*Primary Examiner*—J. Casimer Jacyna
(74) *Attorney, Agent, or Firm*—Duane Morris LLP

(57) ABSTRACT

The invention relates to a blocking device for a beverage dispenser. The technical problem exists of providing a lock for dispensers of this type that can be opened in an uncomplicated manner by the authorized individuals but reliably prevents unauthorized individuals from accessing the contents of the dispenser, however, while at the same time not elevating the security of the lock to such an extent that a loss of a key or of a locking device would lead to a complete inaccessibility to the system, that is to say, not by the authorized individuals as a result of their negligence (loss or misplacing of the key) but by generally unauthorized individuals. To this end, the invention provides a blocking device provided for or on a beverage dispenser comprising a holding device (10) for a beverage and a cover (20) situated above the holding device while provided for covering a filled beverage supply (G). When closed, the cover, with section (21), overlaps the holding device having an edge section (11, 12). A blocking device (30) is displaceably mounted (A,23) in the overlapping section (21). The displaceability (A) of the blocking device (30) is hindered by an obstructing device (40) when the obstructing device is located in a position of rest.

20 Claims, 1 Drawing Sheet

BLOCKING DEVICE FOR A BEVERAGE DISPENSER

BACKGROUND OF THE INVENTION

1. Field of the Invention

The invention relates to a barrier device for a drinks dispenser or such a device on a drinks dispenser. The invention also relates to a locking process for a drinks container, which consists of a lower part (as drinks reservoir for the drink to be mixed or finally mixed drink) and a cover, which as upper part covers the charged drink to air and foreign access. Finally, the invention also relates to the barrier device as such, with which a drinks dispenser made from upper and lower part may be fitted, or with which a process may be carried out, which may lock such a drinks container comprising upper and lower part.

2. Description of the Related Art

From U.S. Pat. No. 2,083,621 (Smith), a container in round form is known, which is covered by a cover, which engages over a container edge with an apron portion. A tongue (18, 32, 33 there), which engages through a flap or eyelet arranged on the container body, is arranged on the container edge when the cover (15, 16 there) is rotated in peripheral direction with respect to the container body. Locking is thus possible, reinforcing the lock by bending the flap, and a complete closure technology by introducing a seal or attaching a wire may completely secure the closed position. An intermediate solution between complete security and easy opening is however not provided due to the flap which is accessible at any time externally. On the other hand, DE-U-295 12 609 (Engelbrecht) intended for a distant technical specialist field, shows a locking device on a large base body which permits closing of the cover with respect to the body, to permit only authorized people to open by wrench, but to permit opening of the large container during emptying thereof (by tilting) to a quite specific circle of people, during which tilting movement the closure device is opened automatically even if no wrench is present. Finally, U.S. Pat. No. 2,809,062 (Mainhardt) shows magnetic locking of door and soffit, wherein a bolt is displaced in its position by a magnet (acting externally), such that it can be displaced axially between a closed position and an open position. The closed position and the open position of the magnet also define the closed position and the open position of the door described there.

A drinks dispenser is described in for example EP-B 1 132 316 (Wolfgang Jobmann). There, the air closure and ensuring the quality of the contents of the drinks dispenser is crucial. With regard to a general design of such a dispenser, reference may be made to this publication. In problem areas, such as for example psychiatric departments or places of detention or even in normal canteen operation without a continuous monitoring facility of such a drinks dispenser, there is a problem inasmuch as unauthorized access to the contents of the drinks dispenser may not be monitored and consequently also not reliably prevented. Herein lies a potential danger not to be underestimated for the contents of the dispenser, which firstly would have to be protected against removal and secondly should also be protected against change (in color, the contents, the quality of the contents, the tone as regards taste of the contents or the medical and health harmlessness).

SUMMARY OF THE INVENTION

Usually, premix dispensers, that is, such drinks dispensers in which liquid contents are present stored finally mixed in the lower part, are not provided with reliable locking, but have freely removable container covers (upper parts).

The technical problem is therefore posed in such premix dispensers to provide locking, which on the one hand may be opened by the authorized personnel without problems, on the other hand reliably stops unauthorized people from access to the contents of the premix dispenser, but at the same time does not raise the security of locking so far that a loss of a wrench of a closing device leads to complete inaccessibility of the system, that is does not make the authorized personnel generally unauthorized people for their carelessness (loss or mislaying of the wrench).

A locking portion, which starts from the upper part, is thus proposed. A portion thus reaches over the lower part and a barrier device is supported displaceably in this portion. This barrier device has a rest position and an open position. The barrier device is locked in the rest position and prevents removal of the upper part from the lower part.

In the open position (an unlocked release state), the lock may be released, in order to remove the cover from the drinks reservoir (the lower part). The open position is the unlocked position for the blocking body (operating position).

To this end, the displaceable barrier device is influenced, particularly inhibited, by a blocking device in its rest position such that the rest position is permanently blocked, so that a displacement of the barrier device at the reaching-over portion is not possible or is possible only inasmuch as the locking position of the upper part with respect to the lower part is not influenced.

The barrier device thus has as a retrofit kit, independent kit or structural element, an elongated locking bolt (also as a plate), which has a recess which accommodates in engaging manner a blocking body in the rest state in order to block the said displacement movement of the locking bolt. The blocking body as such may be released, in particular using a magnet in order to raise the blocking body out of the blocking position, in which it engages into the barrier device (as locking bolt). Raising out is an action against gravitational force, wherein the gravitational force by itself allows the blocking body to engage into the barrier device so that no additional forces, spring forces or other measures are necessary to reach the locking state. Simple pushing in of the barrier device from the unlocking position (the release state) into the locking position (the barrier state) achieves engagement of the blocking body caused by gravitational force into the recess on the barrier device, as a result of which the locking state is secured.

Access for authorized operating personnel results from engagement of a magnet in that region in which the blocking device lies. The blocking device itself responds to magnetic fields and can be raised by the magnetic field which thus has to be sufficiently strong against the action of gravitational force in order to reestablish the displaceability of the barrier device which cannot be magnetised here, which may then be displaced into the release state.

A security possibility lies in the fact that a particularly high magnetic force, which is achieved for example only by an electromagnet, facilitates unblocking of the locking state. Accordingly, the blocking body (as blocking device) is also designed to be so heavy that not just any pocket magnet is able to carry out unblocking.

On the other hand, the exchangeability of the aid designed as a "magnetic wrench" is provided inasmuch as misplacing or loss of this magnet does not generally prevent unblocking. A different security measure is also possible insofar as the drink is first of all completely removed from the removal valve on the lower end of the lower part, in order to then achieve unlocking by the action of gravitational force by inverting the whole apparatus. The blocking body is thus released from the recess of the barrier device and allows displacement from the rest position (the barrier state) into the release state also without assistance of the "magnetic wrench" applying the magnetic force.

This change of position of the blocking body is likewise a change from the rest position (which lies in most cases deeper) into the operating position, which lies in most cases higher, which is geared to the state of the drinks dispenser which stands in the upright state, During inversion of the whole apparatus, this relationship is changed accordingly.

Instead of a single barrier device, several barrier devices may be provided on the periphery of a dispenser, which are at such a distance from one another that together they ensure locking, which also protects a large surface from unauthorized access, hence it is possible, for example to prevent locking provided at only one point from being able to be bypassed by tilting or tipping the cover. For a square design, a particular opposite attachment is available, hence two or four locking devices in each case having magnetically effective blocking body. For a round design of the lower part 10 and therefore also of the upper part, two opposing barrier devices may be sufficient.

The apron portion, which engages over the upper edge of the lower part, may be either laterally restricted in its extension, or annularly, and the upper edge portion may also be this, either designed only where a particular locking device is arranged, or likewise annularly.

The cover may be cleaned hygienically (for example by dishwashing machine) with the engaging apron (portion) which comprises the barrier device, it thus means no additional stress of the hard everyday life of a dispenser to be kept clean regularly and hygienically. Due to the possibility of inverting of the whole apparatus after complete removal, the contents may also be protected reliably. It is indeed not thus protected against unauthorized removal via the removal valve, but may be protected with regard to its total contents in that it is not manipulated by foreign personnel. In the worst case, an unauthorized person may remove the total contents, but may not change the total contents in their color, health or other consistency by adding medically dubious substances.

The security is sufficient and adequate. It is not exaggerated, but also not so easy to overcome that very simple attack on the barrier system is possible by a third party.

DETAILED DESCRIPTION OF THE PREFERRED EMBODIMENTS

Figure 1:
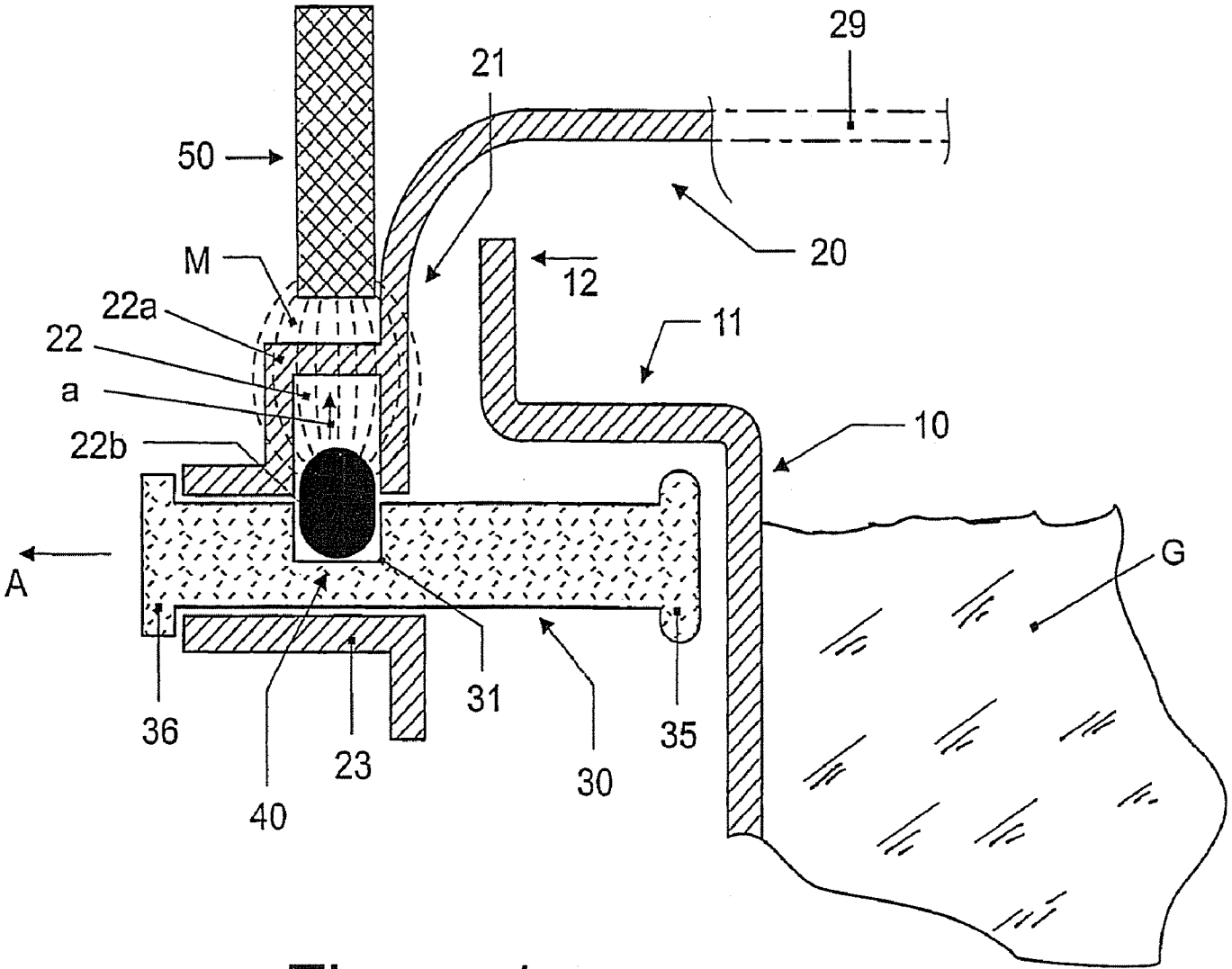
FIG. 1. illustrates a closed drinks container in accordance with the invention.

An embodiment is to illustrate (clarify and supplement) the system of the invention in more detail.

FIG. 1 illustrates a portion between upper part and lower part, on which an example of a barrier device is arranged so that the rest position (the barrier state) is shown. The representation is a sectional view, wherein the remaining region can be easily imagined if conventional drinks dispensers are the base, on which this barrier device may be arranged. The example is thus similar to the mode of operation, for a novel dispenser which has this device already arranged, and an assembly device as such which is available separately as a kit in order to retrofit known dispensers or to pre-fit novel dispensers at the factory.

FIG. 1 illustrates the closed state of a drinks container, to which a cover 20 belongs, which is provided with a cover wall 29 corresponding essentially to the size of the lower part 10 and which may be formed from translucent or transparent plastic. The lower part 10, which is covered by the cover 20 and its cover wall 29, has a large-volume recess body 10, in which a drink G is charged as premix drink, when the cover 20, 29 has been removed. The drink G is covered by the cover 29, 20 after charging into the lower part and the dispenser is closed. Not shown is a removal valve, which is arranged on the lower edge of the drinks container 10, in order to be able to remove, if required, drink from the pre-prepared drinks supply G.

In the left upper portion, the closed state is illustrated with engagement of an apron 21 which starts from the cover 20. The apron engages over an angularly-held projection 11, 12 on the upper edge of the lower part 10 and supports at its lower end portion a housing 22 having an upper cover wall 22*a* and a lower wall opening 22*b*. A flange portion, which has expansion extending in the depth direction of the paper at least in the region of a bolt body 30, projects radially outwards, whereas a displacement support 23 is arranged below this flange and the compartment 22, for at least partial encompassing of the bolt 30, which may be displaced to the left and to the right between compartment 22 and upper flange and lower displacement support 23.

The bolt may be extended as a flat plate piece in the depth direction of the paper. However, it may also be designed as a non-round bar or be designed to be polygonal. Accordingly, the lower opening 22*b* and the lower end portion of the compartment 22 and the flange projecting therefrom and the lower displacement support 23 will be formed. However, the elongated bolt 30 does not extend along the entire periphery, but only on at least one point of the drinks container which is designed to be for example round or polygonal in peripheral direction, in particular quadrilateral.

The barrier device 30 may be provided at several points which are arranged at a distance peripherally or along the periphery of a polygonal body 10, if several locks are to be provided at several peripherally distributed points. Only one locking device on one point of the container is described here, which may also easily be transferred to a different point with appropriate design according to the description referred to here. When providing several spaced locking devices, which each has an independent barrier device 30, in each case such a device may be arranged on a portion of an apron running in lateral direction, or the apron 21 is kept essentially continuous. The projection 11, 12, under which blocking or locking is carried out, may also be designed to be continuous, or only at those points at which a particular barrier device 30 is provided.

The position shown is the locking or rest position, in which the drink is charged, and the cover 20 rests on the lower part 10 serving as recess for the drink, for example on a is resilient mounting not drawn here at a different location than that which is illustrated by the section in FIG. 1.

The rest position has two properties. Firstly, the pin is pushed in to the right in FIG. 1 and engages below the angular projection 11, 12 on the container body 10, so that the cover 20, 29 cannot be removed. Secondly, the inserted bolt is as a barrier device 30 through a round to oval magnetizable body 40 in a blocked state, which blocking body 40 is shown here as non-round in cross-section and may be moved upwards in the compartment 22. It engages in the engaged state through the lower opening 22*b* of the compartment 22, which is covered externally by an upper wall 22*a* to be non-transparent, in order to externally hide the blocking body 40. Engagement of the blocking body 40 in a recess 31 essentially matched to the shape of the blocking body on the locking bolt 30 ensures lateral blocking of the displaceability of the bolt, which may not thus be displaced in direction A—in the rest position shown.

The design of the blocking body 40 is shown in the figure to be round to oval in cross-section. This cross-sectional shape may also be varied considerably in various further embodiments. Hence, for example a bolt piece is possible which, with its axial direction, runs in vertical direction in FIG. 1 and has flat end-face surfaces (top and bottom). This bolt piece may be made from metal and may be covered with a layer which is suitable for food contact applications, hygienical and at least easily washable.

In depth direction (vertically to the plane of the paper of FIG. 1), the blocking body may have a freely selectable shape (or depth or breadth). It may be designed as a ring segment, but it may also be designed according to the above variant as a standing cylindrical or square bolt piece. Accordingly, the inner compartment 22 and the associated outer wall 22*a* of this compartment is also designed to be fitting. If the ring extends on a partial segment of the periphery, it will match with an at least equally flatly extending barrier device 30, which is then rather formed in plate-like manner, with respect to a rather bar-shaped design for a blocking body 40 designed as a sphere or oval.

The closed state of the drinks cover with the engaging portion 21, on which the barrier device described is arranged, ensures that the blocking body 40 operating as blocking device inhibits, in particular completely prevents, the displaceability of the barrier device 30, if matching of the shape and the associated positive locking in the recess 31 is precise. This rest position ensures that the displaceably mounted bolt 30 cannot be displaced in direction A into an operating position and unfolds with its inner end (the end facing the drinks container) a barrier action below the laterally projecting edge portion 11, 12, which prevents release of the cover without changing the position of the blocking body 40.

An opening is possible, if with a magnetic key 50, for example a strong bar magnet or preferably also an electromagnet, which unfolds such a high magnetic force via the magnetic field M that a heavy blocking body 40 may be raised and blocking 40, 31 is released. In addition, the magnetic field M acts externally on the blocking body through the compartment cover 22*a*, raises it against its gravitational force in the direction "a" and permits displacement of the bolt by engagement on the outer gripping portion. The inner portion 35 of the bolt is thus moved outwards and abuts on the inwardly pointing surface of the apron 21. In this stop position, which is the operating position or release position, the barrier is raised and the cover may be removed. The inner end 35 of the locking bolt 30 is thus moved past the outermost portion 12 of the edge portion 11, 12, without considerable contact taking place.

The removed cover releases access to the interior of the container, permits cleaning thereof, and permits cleaning of the container cover 20, even together with the barrier device 30 which is arranged on the cover itself and is also removed.

During closing of the drinks container, the process is carried out in reverse. First of all the barrier device 30 is moved outwards, optionally with turning of the cover 20 so that gravitational force ensures release of the barrier 40, 31 in order to then be able to place the cover in the outwardly released state of the bolt 30 again on the filled container lower part 10.

No further recess, in particular also no depression is provided between the locking recess 31 and the inner end 35 of the locking bolt 30, so that the blocking body 40 can no longer engage here if the first barrier in the recess 31 is removed. In this position of the blocking bolt 30 approaching the release position, the barrier body 40 is held in the compartment 21 in an elevated position, thus here is itself blocked and, during insertion of the locking bolt 30, due to its gravitational force automatically falls into the blocking or locking position, which is shown in FIG. 1.

To facilitate this stroke movement, the compartment 22 has a height matched to the height of the blocking body 40. It is at least so high that the blocking body 40 may leave the recess 31 and produces the displaceability of the bolt 30.

The two end portions, firstly the gripping portion 36 and secondly the inner locking portion 35 of the bolt may be designed to be thickened or broader in order to achieve an improved effect and in order to facilitate the displaceability within the guide portions 23 or the underside of the compartment 22 with the outwardly projecting flange. Hence, the bolt 30 may not fall out from the apron portion 21 and forms with it a coherent functional unit.

The described embodiment can also be realised as a constructional unit, wherein a corresponding assembly portion is joined to the apron portion 21, the assembly portion being arranged on an upper part of a drinks container not yet provided with locking. This assembly portion may run for example horizontally, in order to be able to be assembled on the cover wall 29, at least an outer portion of this cover wall 29, for example by adhering or assembling using a screw device which is not accessible externally.

The magnetic device 50 serving as "wrench" (or key) is drawn here as a bar magnet, but is preferably a stronger electromagnet, which is able to raise a blocking body matched as regards the weight to a stroke force imparted by the magnetic field M. The electromagnet prevents foreign use due to a small magnet or a pocket magnet already being able to lead to possible unlocking. The arrangement of the blocking body 40 in the compartment 22 in turn also facilitates opening of the lower part 10 by removing the cover, or by unblocking the barrier device if a magnet is not available or is lost or just misplaced. The drink G may then be removed completely from the described outlet (the valve or removal valve), the entire dispenser may be placed on its head. Locking in the recess 31 is thus released by the gravitational force. The direction "a" is thus inverted downwards. Subsequent cleaning of the cover and of the entire container and re-filling is possible, even if the magnetic wrench was displaced.

By shaping the bolt 30 as a non-round bolt, for example flat bar or quadrangular or polygonal bolt body, twisting may be avoided. Also, manipulation by rotating, in particular by attempted upward pressing of the blocking body 40 may be prevented by such a design. However, it is thus to be ensured that the guide 23, 22, in which the displaceable barrier device is guided, has the corresponding counter-shape, in order to guarantee the essentially positively designed guide and rotary barrier.

The locking bolt and the barrier body may be formed from hygienically faultless material formed at least on their surface in order to be able to clean them together with the cover and the container in a dishwashing machine.

To be able to use the magnet, the blocking body 40 may consist either as a whole of magnetisable material or of such a hygienically faultless material, which contains essential portions which can be magnetised. On the one hand, a plastic material filled with iron particles is thus possible, as it is also to consider a material consisting in the core of a soft iron and which has an outer coating which meets the hygienic requirements.

A hygienically faultless solution, that is a solution to be cleaned hygienically, is provided by the embodiment described, which is firmly connected to the cover 20, 29. It is adequately safe with regard to foreign intervention or foreign manipulation and not over-safe to the extent that operating personnel subject to forgetfulness are generally prevented from re-filling or even cleaning the drinks dispenser. If the magnet required for raising the blocking body 40 should be lost, operating personnel may nevertheless open the emptied container by using the gravitational force opening (turning the container as a whole) and carry out their maintenance work (washing, re-charge drink and then closing and re-erecting the drinks container at the indicated site).

I claim:

1. A barrier arrangement for a drinks container dispenser, having a reservoir (10) for drink and a cover (20) above the reservoir wherein the barrier arrangement is disposed on a peripheral portion (21) of the cover (20), wherein the peripheral portion (21) reaching over an edge portion (11, 12) of the reservoir when the cover is closing the reservoir (10) said edge portion including at least a flange projecting radially outwardly from said reservoir (10);

the barrier arrangement located at said peripheral portion (21) of the cover comprising an elongate bolt (30) having a first end, a second end, and a transversely oriented recess located between said ends, said bolt being slidably supported on the peripheral portion of the cover within a support housing formed by a guide member (23) and a cover wall (22*a*) that together define a compartment that houses a magnetic block (40) sized for at least partial receipt within said transversely oriented recess in the absence of a magnetic field being applied through said cover wall (22*a*) such that said bolt (30) can be slid between:

(i) a first position wherein said magnetic block is positioned within said recess while said first end of said bolt is located below said flange thereby locking said cover onto said reservoir; and (ii) a second position wherein said magnetic block is positioned within said compartment in response to the application of a magnetic field creating an attractive force such that said first end of said bolt is spaced away from said flange thereby unlocking said cover from said reservoir.

2. Barrier arrangement according to claim 1, wherein the displaceability of the bolt device (30) is released if the magnetic block (40) is in an operating position.

3. Barrier arrangement according to claim 2, wherein the locking position of the magnetic block device (40) is lower than or below the operating position thereof.

4. Barrier arrangement according to claim 1, wherein the magnetic block is a magnetizable blocking device (40), or is liftable, by a magnet (50), to allow a movement from the locking position as rest position into the operating position, or to release the locking position for a movement of the bolt as a barrier device into an unlocked position.

5. Barrier arrangement according to claim 4, wherein the operating position is higher than the rest position, and the magnetisable blocking device (40) is liftable or is lifted against a gravitational force thereof by the magnet (50), providing said magnetic field (M) acting externally on the blocking device (40).

6. Barrier arrangement according to claim 1, wherein the compartment (22) provided at the peripheral portion (21) of the cover is at least difficult to access externally by a mechanical device.

7. Barrier arrangement according to claim 6, wherein the compartment is formed by a compartment wall (22*a*) as a cover wall, externally covering the magnetic block (40), and at least one wall opening (22*b*) is provided internally in a direction of the bolt device (30).

8. Barrier arrangement according to claim 1, wherein the bolt (30) is shaped as an elongated pin, supported essentially non-rotatably in the guide member (23) on the peripheral portion of the cover.

9. Barrier arrangement according to claim 1, wherein the bolt has a non-round cross-section.

10. Barrier arrangement according to claim 1, wherein the bolt (30) is at both ends thereof shaped to limit a displaceability by each end shape, by abutting at the peripheral portion (21, 23) of the cover.

11. Barrier arrangement according to claim 1, wherein the cover (20) has several barrier arrangements arranged in distributed manner, each of which being arranged at one respective portion of the peripheral portion of the cover (20).

12. Barrier arrangement according to claim 11, wherein the several peripheral portions form an essentially annular apron.

13. Barrier arrangement according to claim 11, wherein several flanges project on from the reservoir and each one being associated with one of the several barrier arrangements.

14. Barrier arrangement according to claim 13, wherein the projecting flange is annular on the reservoir (10).

15. Barrier arrangement according claim 1 wherein the magnetic block (40) and the bolt device (30) have at least on their surface a material which is hygienic, at least easily washable.

16. Barrier arrangement according to claim 1 wherein the magnetic block (40) is of round to oval shape having a minimum weight suitable for locking the bolt.

17. Barrier arrangement according to claim 1 wherein the magnetic block (40) is shaped as a metallic bolt piece.

18. Barrier arrangement of claim 1, the bolt designed as a polygonal bar.

19. Barrier arrangement of claim 17, the magnetic block having a polygonal cross-section.

20. A drinks dispenser, having a reservoir (10) for holding a drink and a cover (20) above the reservoir, to cover a filled-in drink as supply (G), wherein a barrier arrangement is disposed on a peripheral portion (21) of the cover (20);

the peripheral portion (21) reaching over an edge portion of the reservoir when the cover is closing the reservoir (10) said edge portion defining an open end of said reservoir (10); and the barrier arrangement located at said peripheral portion (21) of the cover comprising an elongate bolt (30) having a first end, a second end, and a transversely oriented recess located between said ends, said bolt being slidably supported on the peripheral portion of the cover within a support housing formed by a guide member (23) and a cover wall (22*a*) that together define a compartment that houses a magnetizable block sized for at least position received within said transversely oriented recess in the absence of a magnetic field being applied to said magnetizable block such that said bolt (30) can be slid between a first position wherein said block is within said recess while said first end of said bolt is located below a flange of the edge portion thereby locking said cover onto said reservoir; and a second position wherein said block is positioned within said compartment in response to the application of an attractive magnetic force such that said first end of said bolt is spaced away from said flange thereby unlocking said cover from said reservoir.

* * * * *

UNITED STATES PATENT AND TRADEMARK OFFICE

CERTIFICATE OF CORRECTION

PATENT NO. : 7,717,298 B2
APPLICATION NO. : 10/538251
DATED : May 18, 2010
INVENTOR(S) : Wolfgang Jobmann It is certified that error appears in the above-identified patent and that said Letters Patent is hereby corrected as shown below:

Column 8, line 20, delete “on” and insert --from--.

Signed and Sealed this
First Day of March, 2011

David J. Kappos

David J. Kappos
*Director of the United States Patent and Trademark Office*